US009589742B2

(12) United States Patent
Shiine et al.

(10) Patent No.: US 9,589,742 B2
(45) Date of Patent: Mar. 7, 2017

(54) PRESSING OPERATION DEVICE

(71) Applicant: ALPS ELECTRIC CO., LTD., Tokyo (JP)

(72) Inventors: Tomohiro Shiine, Miyagi-ken (JP); Hajime Suzuki, Miyagi-ken (JP); Takao Igarashi, Miyagi-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/017,438

(22) Filed: Feb. 5, 2016

(65) Prior Publication Data

US 2016/0260553 A1 Sep. 8, 2016

(30) Foreign Application Priority Data

Mar. 4, 2015 (JP) ..... 2015-042366

(51) Int. Cl.
*H01H 3/12* (2006.01)
*H01H 3/00* (2006.01)

(52) U.S. Cl.
CPC ..... *H01H 3/122* (2013.01); *H01H 2003/008* (2013.01); *H01H 2215/05* (2013.01); *H01H 2221/024* (2013.01); *H01H 2221/062* (2013.01)

(58) Field of Classification Search
CPC ..... H01H 3/122; H01H 2003/008; H01H 2215/05; H01H 2221/024; H01H 2221/062
USPC ..... 200/308, 251, 52 R, 406, 6 A, 512–513, 200/516–517, 521
See application file for complete search history.

(56) References Cited

U.S. PATENT DOCUMENTS 5,117,076 A 5/1992 Damitio
5,466,901 A * 11/1995 Mochizuki ..... H01H 3/125 200/344
6,455,794 B2 * 9/2002 Sato ..... H01H 3/122 200/344
6,586,695 B2 * 7/2003 Sato ..... H01H 3/122 200/344

FOREIGN PATENT DOCUMENTS

JP 3-37723 U 4/1991
JP 7-22820 Y2 5/1995

* cited by examiner

*Primary Examiner* — Edwin A. Leon
(74) *Attorney, Agent, or Firm* — Beyer Law Group LLP

(57) ABSTRACT

A pressing operation device is configured such that a base and an operating body are linked to each other by a link member. A support-side shaft of the link member is rotatably supported by a bearing of the base. The bearing of the base includes a first regulation portion that regulates movement of the support-side shaft of the link member in an ascending direction of the operating body and a second regulation portion that regulates movement of the support-side shaft in a direction intersecting the ascending direction, and is provided with a flat spring portion that presses the support-side shaft against the second regulation portion and the first regulation portion.

5 Claims, 4 Drawing Sheets

PRESSING OPERATION DEVICE

CLAIM OF PRIORITY

This application claims benefit of Japanese Patent Application No. 2015-042366 filed on Mar. 4, 2015, which is hereby incorporated by reference.

BACKGROUND OF THE INVENTION

1. Field of the Invention

The present invention relates to a pressing operation device including an operating portion which is pushed down by an operator.

2. Description of the Related Art

A pressing operation device is incorporated in, for example, the handle, the instrument panel or the like of an automobile, and an operation performed by an occupant is input thereto.

A structure applicable to such a pressing operation device is disclosed in Japanese Unexamined Utility Model Registration Application Publication No. 3-37723. In a keytop installation structure disclosed in Japanese Unexamined Utility Model Registration Application Publication No. 3-37723, a keytop and a fixed member such as a printed substrate are linked to each other by a link member constituted by a wire, to thereby prevent the keytop from being inclined.

In the installation structure, looseness is provided in linkage between the keytop and the fixed member, and the link member so as to smoothly push down the keytop. Therefore, when a pressing operation device having such an installation structure adopted therein is mounted on a moving object such as an automobile, the backlash of the link member occurs due to a vibration, which results in a concern of abnormal noise being generated.

SUMMARY OF THE INVENTION

Consequently, the present invention provides a pressing operation device which is capable of suppressing the backlash of a link member caused by a vibration.

According to the present invention, there is provided a pressing operation device including: a base; an operating body which is liftably provided in the base; and a link member configured to link the base and the operating body together. The link member is configured such that a support-side shaft, a link-side shaft, and a connection portion for connecting the support-side shaft to the link-side shaft are formed to be integrated with each other, and that the support-side shaft and the link-side shaft are disposed on a parallel line. The support-side shaft is rotatably supported by a bearing provided in the base, and the link-side shaft is rotatably linked to the operating body. The bearing includes a first regulation portion configured to regulate movement of the support-side shaft in an ascending direction of the operating body and a second regulation portion configured to regulate movement of the support-side shaft in a direction intersecting the ascending direction, and is provided with a spring member configured to press the support-side shaft against both the first regulation portion and the second regulation portion.

According to the present invention, the bearing of the base includes the first regulation portion configured to regulate the movement of the support-side shaft of the link member in an ascending direction of the operating body and the second regulation portion configured to regulate the movement of the support-side shaft in a direction intersecting the ascending direction, and is a provided with the spring member configured to press the support-side shaft against both the first regulation portion and the second regulation portion. Thereby, since it is possible to maintain a state where the support-side shaft of the link member is rotatably supported by the first regulation portion, the second regulation portion and the spring member, and the support-side shaft of the link member is pressed against the first regulation portion and the second regulation portion by the spring member, looseness between the base and the link member is eliminated, and thus it is possible to suppress backlash due to a vibration.

In the pressing operation device, it is preferable that the bearing is provided with an intersection point where the first regulation portion and the second regulation portion intersect each other, and the support-side shaft is pressed toward the intersection point by the spring member. In this manner, it is possible to equally press the support-side shaft against the first regulation portion and the second regulation portion through the spring member, and to effectively suppress backlash due to a vibration.

In the pressing operation device, it is preferable that the spring member includes an inclined pressing portion which is inclined in the ascending direction, the inclined pressing portion facing both the first regulation portion and the second regulation portion, and that the support-side shaft is pressed against both the first regulation portion and the second regulation portion by the inclined pressing portion. In this manner, it is possible to support the support-side shaft of the link member from three directions through the first regulation portion, the second regulation portion and the inclined pressing portion, and to suppress backlash due to a vibration with a relatively simple configuration.

In the inclined pressing portion, it is preferable that the inclined pressing portion extends away from a tip of the first regulation portion and further obliquely toward the ascending direction, and that, when the operating body is incorporated in the base, the support-side shaft comes into contact with the inclined pressing portion, and is guided to a position of contact with both the first regulation portion and the second regulation portion. In this manner, the support-side shaft of the link member is moved closer to the base side from the operating body side, and the support-side shaft is contacted and compressed with and into the inclined pressing portion, so that the support-side shaft is guided into a space surrounded by the first regulation portion, the second regulation portion and the inclined pressing portion, thereby allowing the support-side shaft to be positioned and supported within the space. Therefore, it is possible to relatively easily assemble the pressing operation device.

In the pressing operation device, it is preferable that a vibration generation portion configured to give a vibration force to the operating body is provided when the operating body is pressed. In this manner, when a vibration due to the vibration generation portion is transmitted to an operator as a response to an operation input to the operating body, or the like, this vibration is transmitted from the operating body through the link member to the spring member. Therefore, the vibration of the operating body is effectively attenuated by the spring member, and thus it is possible to more efficiently control the vibration.

According to the present invention, it is possible to effectively suppress backlash due to a vibration of the link member that links the base and the operating body together.

DESCRIPTION OF THE PREFERRED EMBODIMENTS

Hereinafter, a pressing operation device according to an embodiment of the present invention will be described with reference to FIG. 1 to FIG. 4C.

Figure 1:
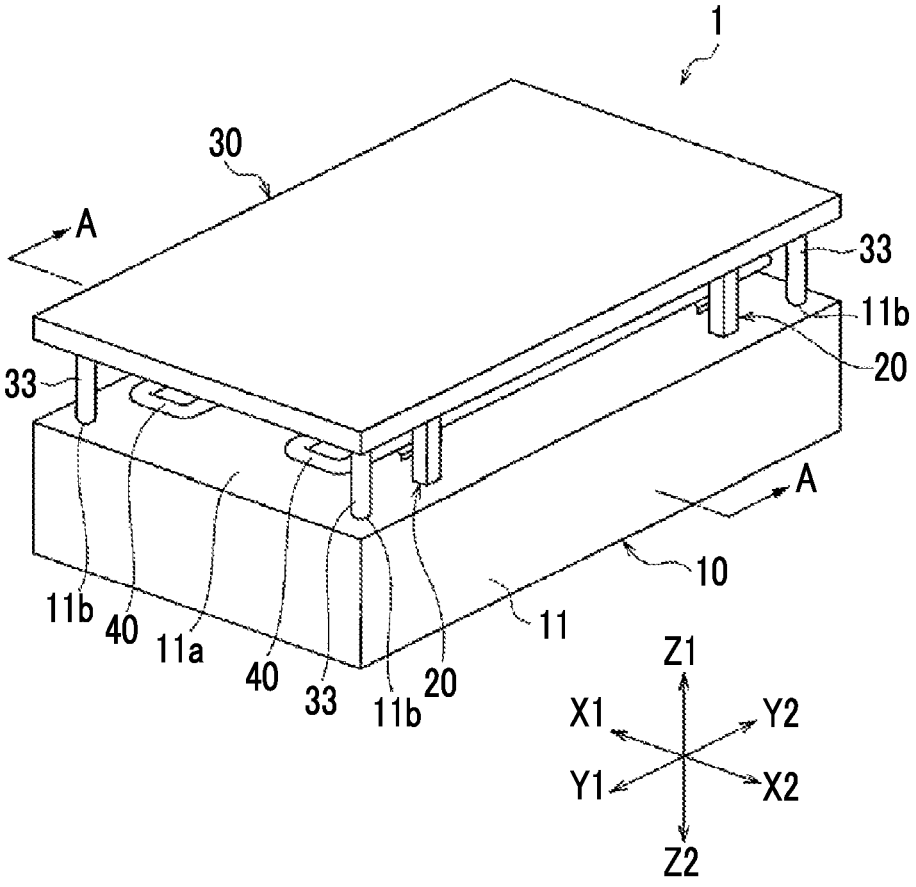
FIG. 1 is a perspective view illustrating a pressing operation device according to an embodiment of the present invention.
Figure 2A:
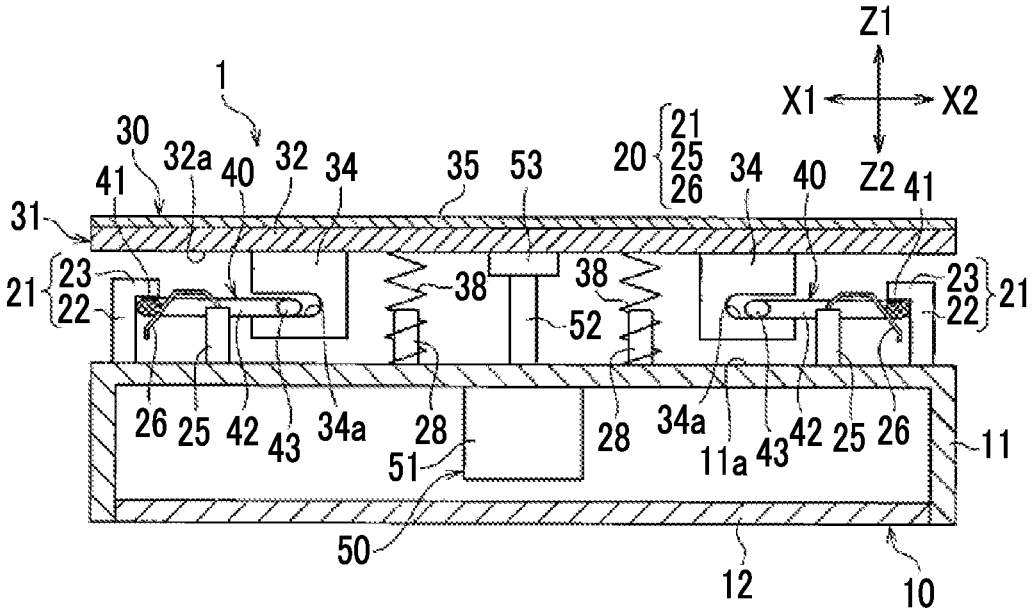
FIGS. 2A and 2B are cross-sectional views taken along line A-A of FIG. 1.
Figure 2B:
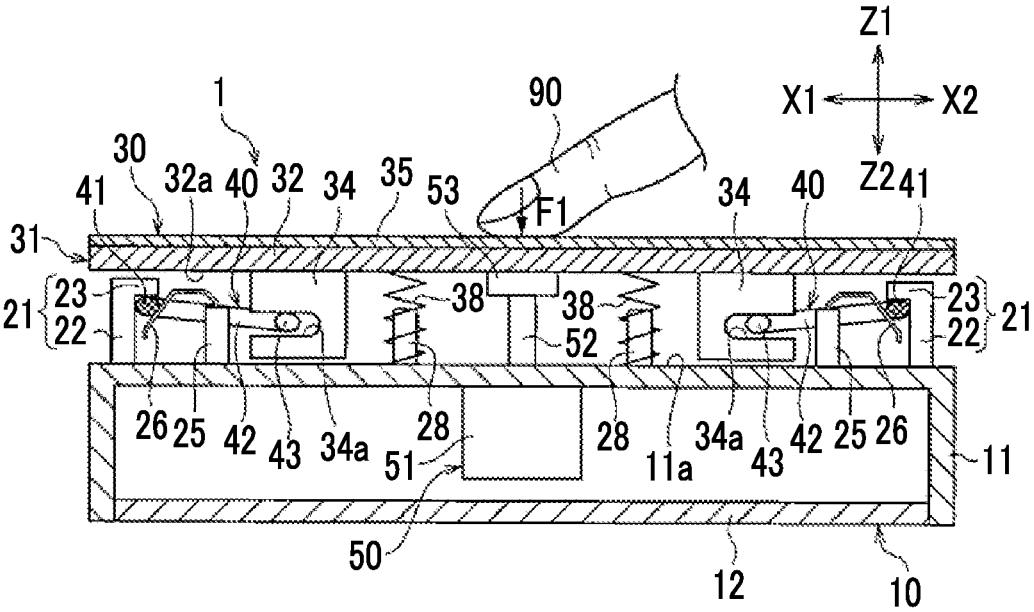
Figure 3:
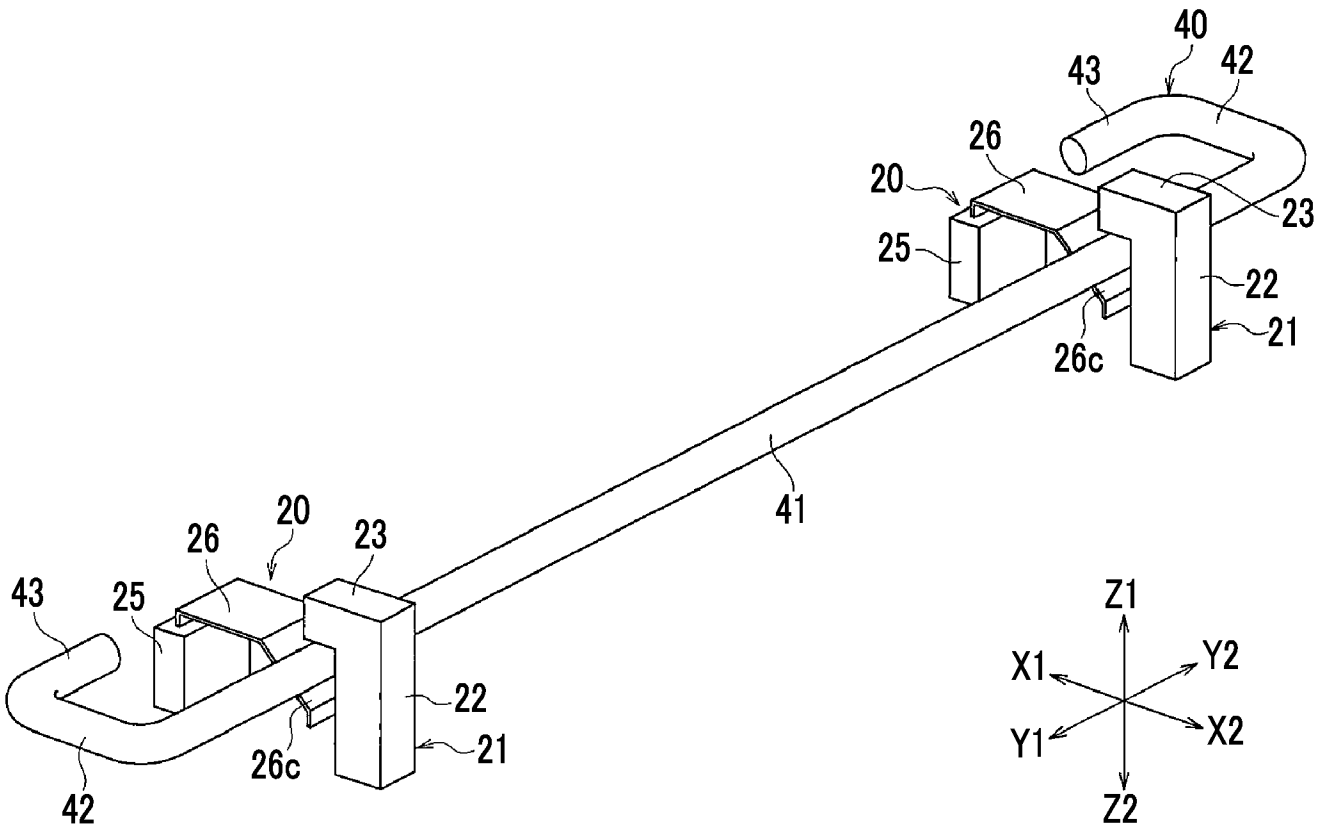
FIG. 3 is an enlarged perspective view illustrating a link member of the pressing operation device of FIG. 1 and the periphery thereof.
Figure 4A:
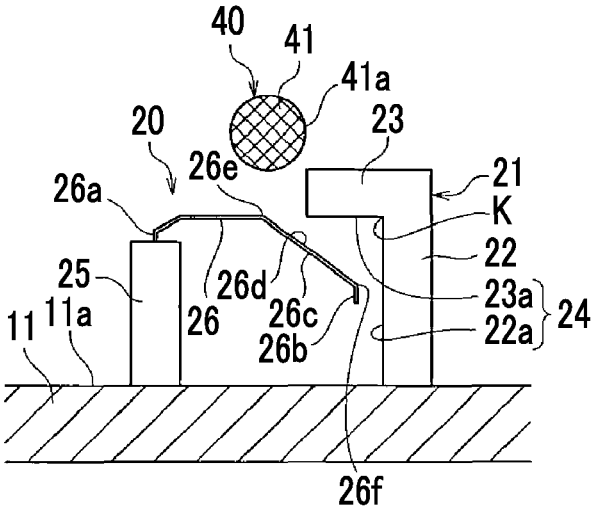
FIGS. 4A to 4C are diagrams illustrating a method of installing the link member of the pressing operation device of FIG. 1 on a base.
Figure 4B:
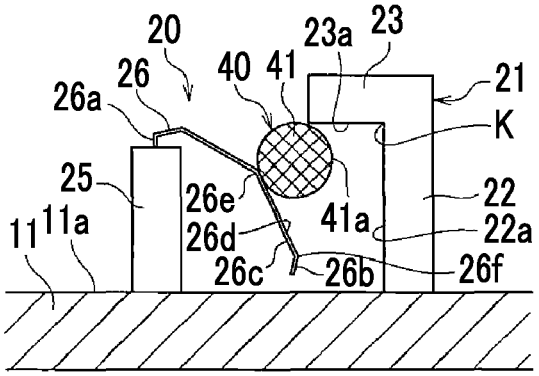
Figure 4C:
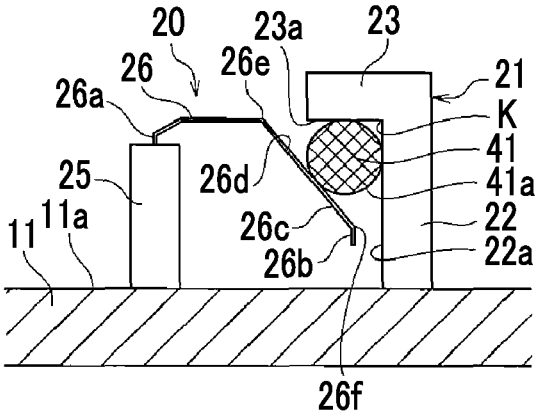

FIG. 1 is a perspective view illustrating a pressing operation device according to an embodiment of the present invention. FIGS. 2A and 2B are cross-sectional views taken along line A-A of FIG. 1; FIG. 2A shows a state where an operating body is not compressed, and FIG. 2B shows a state where the operating body is compressed. FIG. 3 is an enlarged perspective view illustrating a link member of the pressing operation device of FIG. 1 and the periphery thereof. FIGS. 4A to 4C are diagrams illustrating a method of installing the link member of the pressing operation device of FIG. 1 on a bearing of a base; FIG. 4A shows a state before the link member is installed on a bearing, FIG. 4B is a state where the link member is compressed into the bearing, and FIG. 4C is a state after the link member is installed on the bearing.

A direction X1-X2 and a direction Y1-Y2 shown in each drawing show two directions intersecting each other within one plane, and a direction Z1-Z2 shows a direction intersecting the one plane. Each of the directions is shown for convenience for the purpose of the description of a relative positional relationship between components of the pressing operation device. In the following description, as an example, a plane including the direction X1-X2 and the direction Y1-Y2 is set to a horizontal plane, and the direction Z1-Z2 is set to a vertical direction (up and down direction).

A pressing operation device 1 in the present embodiment is incorporated in, for example, the handle, the instrument panel or the like of an automobile, and an operation performed by an occupant is input thereto.

As shown in FIGS. 1 to 3, the pressing operation device 1 includes a base 10, an operating body 30, a coil spring 38, a pair of link members 40, and a vibration generation portion 50.

The base 10 includes an upper case 11, a lower case 12, a plurality of bearings 20, and a spring support-side shaft 28.

The upper case 11 is made of a metal or a synthetic resin, and is formed in a box shape which is open toward the lower side (direction Z2). The lower case 12 is made of a metal or a synthetic resin similarly to the upper case 11, is formed in a rectangular flat shape, and is installed on the upper case 11 so as to close an opening of the upper case 11.

The plurality of bearings 20 are disposed around four corners of an upper surface 11*a* of the upper case 11. In the present embodiment, four bearings 20 are provided, and is configured to form each of a set of two bearings 20 lined up in the axial direction (direction Y1-Y2) of a support-side shaft 41 of the link member 40 described later, and to rotatably support the support-side shaft 41.

Each of the bearings 20 includes a shaft body 21, a spring support portion 25, and a flat spring portion 26 as a spring member.

The shaft body 21 is disposed upright on the upper surface 11*a* of the upper case 11, and includes a second regulation portion 22 having a quadrangular cylindrical shape extending toward the upper side (direction Z1) and a first regulation portion 23 having a quadrangular cylindrical shape protruding from the tip of the second regulation portion 22 in the X1 direction or the X2 direction which are formed integrally with each other. The shaft body 21 is formed to be approximately L-shaped when viewed from the axial direction.

A circumferential surface 41*a* of the support-side shaft 41 of the link member 40 is slidably contacted with two surfaces located on the approximately L-shaped inner side of the shaft body 21. Hereinafter, out of these two surfaces, the lateral side of the second regulation portion 22 facing the circumferential surface 41*a* is referred to as a "second sliding contact surface portion 22*a*", the lateral side of the first regulation portion 23 facing the circumferential surface 41*a* is referred to as a "first sliding contact surface portion 23*a*", and the second sliding contact surface portion 22*a* and the first sliding contact surface portion 23*a* are referred to as a sliding contact surface 24 collectively.

As shown in FIG. 4C, the support-side shaft 41 of the link member 40 is configured such that movement in an ascending direction (direction Z1) is regulated by being brought into contact with the first sliding contact surface portion 23*a*, and that movement in a direction (direction X1 or direction X2) intersecting the ascending direction is regulated by being brought into contact with the second sliding contact surface portion 22*a*.

In the present embodiment, the second sliding contact surface portion 22*a* and the first sliding contact surface portion 23*a* are orthogonal to each other, there is no limitation thereto. The second sliding contact surface portion 22*a* and the first sliding contact surface portion 23*a* intersect each other so that the circumferential surface 41*a* of the support-side shaft 41 comes into sliding contact therewith by disposing the support-side shaft 41 of the link member 40 at the inner side. When the movement in the ascending direction of the support-side shaft 41 and the direction intersecting the ascending direction is regulated, the intersection angle is arbitrary. In addition, the second sliding contact surface portion 22*a* and the first sliding contact surface portion 23*a* may directly intersect each other as in the present embodiment, or respective virtual extending surfaces may intersect each other. In addition, the second sliding contact surface portion 22*a* and the first sliding contact surface portion 23*a* may have curved surfaces and the like other than the flat surface, and an intersection point K shown in FIGS. 4A to 4C may have a concave surface.

The spring support portion 25 is disposed upright on the upper surface 11*a* of the upper case 11, and is formed in a quadrangular cylindrical shape extending upward. The spring support portion 25 is disposed so as to face the shaft body 21 closer to the center of the upper surface 11*a* and at a distance from the shaft body 21 in the direction X1-X2. The spring support portion 25 may be disposed so as to be shifted (at a distance from) to the shaft body 21 in the axial direction of the support-side shaft 41 of the link member 40.

The flat spring portion 26 is a flat spring formed by bending an elastically deformable sheet metal. As shown in FIGS. 4A to 4C, the flat spring portion 26 is configured such that one end 26*a* is embedded in the tip of the spring support portion 25, and that the other end 26*b* serves as a free end.

The flat spring portion 26 is configured such that a flat plate-like inclined pressing portion 26*c* is formed at a point closer to the other end 26*b*. The inclined pressing portion 26*c* is disposed facing each of the first sliding contact surface portion 23*a* and the second sliding contact surface portion 22*a* so as to be inclined with respect thereto. That is, the inclined pressing portion 26*c* is inclined in an ascending direction. One surface 26*d* of the inclined pressing portion 26*c* is disposed so as to be directed to the intersection point K between the second sliding contact surface portion 22*a* and the first sliding contact surface portion 23*a* of the shaft body 21.

As shown in FIG. 4A, the flat spring portion 26 is configured such that, in a state before the support-side shaft 41 of the link member 40 is supported, one edge 26*e* on the upper side (the operating body 30 side) of the inclined pressing portion 26*c* is disposed apart from the first regulation portion 23 in the protruding direction thereof, the other edge 26*f* on the lower side (upper case 11 side) thereof is disposed on the approximately L-shaped inner side of the shaft body 21, and that the inclined pressing portion 26*c* extends obliquely downward. Here, when attention is focused on a positional relationship between the inclined pressing portion 26*c* and the first regulation portion 23, the inclined pressing portion 26*c* extend obliquely toward the ascending direction from the other edge 26*f*, is away from the tip of the first regulation portion 23 in the protruding direction of the first regulation portion 23, and extend further obliquely toward the ascending direction.

In addition, as shown in FIG. 4B, when the support-side shaft 41 of the link member 40 is supported by the bearing 20, the flat spring portion 26 is provided so that the inclined pressing portion 26*c* is elastically deformed in a direction away from the intersection point K from the state of FIG. 4A.

The spring support-side shaft 28 is disposed upright on the upper surface 11*a* of the upper case 11, and is formed in a cylindrical shape extending upward.

The operating body 30 is provided liftably with respect to the base 10 (that is, movably in a direction approaching the base and a direction away therefrom). As shown in FIGS. 2A and 2B, the operating body 30 includes an operating base member 31 and an operating plate 35.

The operating base member 31 is made of a metal or a synthetic resin, and includes a base member body 32 having a rectangular flat shape, a plurality of guide shafts 33, and a plurality of link member support portions 34 which are formed integrally with each other.

As shown in FIG. 1, the plurality of guide shafts 33 are disposed upright at four corners on a lower surface 32*a* of the base member body 32, and are formed in a cylindrical shape extending downward. In a state where the operating body 30 is not pushed down, the tips of the plurality of guide shafts 33 are loosely fit and inserted into through-holes 11*b* provided at four corners on the upper surface 11*a* of the upper case 11. The plurality of guide shafts 33 penetrates into the upper case 11 while being guided to the through-holes 11*b* when the operating body 30 is pushed down, and contribute to maintaining the horizontal posture of the base member body 32 during the vertical movement of the operating body 30. Meanwhile, in FIGS. 2A and 2B, the plurality of guide shafts 33 are not shown.

The plurality of link member support portions 34 are disposed upright at points located further centrally than the plurality of guide shafts 33 on the lower surface 32*a* of the base member body 32, and are formed in a flat shape extending downward. The plurality of link member support portions 34 are disposed so as to intersect each other in the axial direction of the support-side shaft 41 of the link member 40, and have notches 34*a* in the direction X1 or the direction X2 formed therein. The link member support portion 34 has a link-side shaft 43 of the link member 40 inserted into the notch 34*a*, to thereby support the link-side shaft 43 rotatably and slidably in the direction (direction X1-X2) intersecting the shaft central line.

The operating plate 35 is made of a synthetic resin, and is formed in a rectangular flat shape which is the same as the shape of the base member body 32 of the operating base member 31 when seen in a plan view. The operating plate 35 is fixed onto the upper surface of the operating base member 31 in an overlapped state. The operating plate 35 is configured to have a coordinate input device such as an electrostatic sensor mounted on its surface or its rear surface, and to be capable of detecting which position on the operating plate 35 an operator's finger 90 touches.

The coil spring 38 is installed on the spring support-side shaft 28 provided on the upper surface 11*a* of the upper case 11, and is disposed between the upper surface 11*a* of the upper case 11 and the lower surface 32*a* of the base member body 32 in a compressed state. The coil spring 38 upward biases the operating body 30 (that is, an upward force is applied to the operating body 30).

Each of the pair of link members 40 is formed so that a cross-sectional circular metal wire is bent in an approximately C-shape when seen in a plan view. As shown in FIG. 3, the link member 40 includes a support-side shaft 41 extending linearly, a pair of connection portions 42 extending from both ends of the support-side shaft 41 in the same direction intersecting the axial direction of the support-side shaft 41 (that is, radial direction of the support-side shaft 41, or X1 direction in FIG. 3), and a pair of link-side shafts 43 extending in a direction coming close to each other from the respective tips of the pair of connection portions 42 and in parallel to the axial direction. The shaft central line of the support-side shaft 41 and the shaft central line of the pair of link-side shafts 43 are located on lines parallel to each other. Therefore, reversely to FIG. 3, the link-side shaft 43 may extend out to the connection portion 42 outside in the direction Y1 and the direction Y2.

The support-side shaft 41 is rotatably supported by the bearing 20 of the base 10. Specifically, the support-side shaft 41 is supported by the shaft body 21 and the flat spring portion 26 (FIG. 4C). In this case, the circumferential surface 41*a* of the support-side shaft 41 comes into contact with the second sliding contact surface portion 22*a*, the first sliding contact surface portion 23*a*, and one surface 26*d* of the inclined pressing portion 26*c*, and the circumferential surface 41*a* of the support-side shaft 41 is slidably moved with the respective surfaces during the rotation thereof. In addition, the circumferential surface 41*a* of the support-side shaft 41 is pressed toward the intersection point K between the first sliding contact surface portion 23*a* and the second sliding contact surface portion 22*a* due to a force by which the elastic deformation of the flat spring portion 26 is restored. Thereby, the circumferential surface 41*a* of the support-side shaft 41 is substantially equally pressed against both the first sliding contact surface portion 23*a* and the second sliding contact surface portion 22*a*.

As shown in FIGS. 2A and 2B, the vibration generation portion 50 includes a main body 51, a plunger 52 which is movably supported in a vertical direction by the main body 51, and an elastic member 53 made of silicon rubber or the like which is provided between the plunger 52 and the base member body 32. The main body 51 includes a solenoid mechanism, and causes the plunger 52 to minutely vibrate in a vertical direction through intermittent electrification to the solenoid mechanism. The elastic member 53 is installed on the tip of the plunger 52 so as to be vertically slidable along with the base member body 32, and transmits the minute vibration of the plunger 52 to the base member body 32. The vibration generation portion 50 may be configured using an eccentric motor. The vibration generation portion 50 causes the plunger 52 to minutely vibrate through the main body 51 when the operating body is pressed, to thereby give a vibration force to the operating body through the elastic member 53.

In addition, the vibration generation portion 50 has a push switch built-in, and the push switch operates when the operating body 30 is pushed down.

In the above-mentioned pressing operation device 1, the operating body 30 is biased upward by the coil spring 38. Thereby, as shown in FIG. 2A, in a state where an operation is not input to the operating body 30 (state where the operating body 30 is not biased), the link member support portion 34 of the operating body 30 is pressed against the link-side shaft 43 of the link member 40 which is located within the notch 34*a*.

When a force F1 for pushing down the operating body 30 downward is applied by the operator's finger 90, the operating body 30 moves downward as shown in FIG. 2B. In this case, the support-side shaft 41 of the link member 40 is slidably rotated in one direction within the bearing 20, and the link-side shaft 43 is trembled around the support-side shaft 41. The link member 40 equalizes the amounts of push-down of two points in the operating body 30 which are away from each other in the axial direction, and contributes to maintaining the horizontal posture of the operating body 30. The link-side shaft 43 moves within the notch 34*a* in any one direction of the directions X1-X2, along with the downward movement of the operating body 30. When the operating body 30 is pressed downward, and the push switch is brought into operation, the switching signal is given to a control portion, and the vibration generation portion 50 operates to thereby cause the operating body 30 to vibrate.

When the operator's finger 90 is away from the operating body 30 and the force F1 is thus removed, the operating body 30 moves upward due to the biasing force of the coil spring 38. In this case, the support-side shaft 41 of the link member 40 is slidably rotated within the bearing 20 in other directions, and thus the link-side shaft 43 is trembled around the support-side shaft 41. The link-side shaft 43 moves within the notch 34*a* in any one direction of the directions X1-X2, along with the downward movement of the operating body 30. The link-side shaft returns to the original state shown in FIG. 2A.

Next, a process of installing the base 10 and the link member 40 in the assembly work of the above-mentioned pressing operation device 1 will be described with reference to FIGS. 4A to 4C.

In the above-mentioned pressing operation device 1, the link member 40 is previously installed on the operating body 30 by inserting the link-side shaft 43 of the link member 40 into the notch 34*a* of the link member support portion 34 of the operating body 30, and the operating body 30 is moved close to the upper case 11 in a state where the lower surface 32*a* of the base member body 32 is directed to the upper surface 11*a* of the upper case 11. In this case, as shown in FIG. 4A, the support-side shaft 41 of the link member 40 is located above the bearing 20.

As shown in FIG. 4B, when the support-side shaft 41 is compressed into a gap between the first regulation portion 23 of the shaft body 21 and the flat spring portion 26, the flat spring portion 26 is elastically deformed so that the inclined pressing portion 26*c* is away from the intersection point K, and thus the support-side shaft 41 leads into the approximately L-shaped inner side of the shaft body 21.

Thereafter, as shown in FIG. 4C, the support-side shaft 41 is guided between the shaft body 21 and the flat spring portion 26, and the circumferential surface 41*a* of the support-side shaft 41 is supported by the bearing 20 in a state of being contacted with the second sliding contact surface portion 22*a*, the first sliding contact surface portion 23*a*, and one surface 26*d* of the inclined pressing portion 26*c*. In this case, the support-side shaft 41 is pressed toward the intersection point K between the second sliding contact surface portion 22*a* and the first sliding contact surface portion 23*a* by the inclined pressing portion 26*c* of the flat spring portion 26.

As described above, according to the pressing operation device 1, the bearing 20 of the base 10 includes the first regulation portion 23 that regulates the movement of the support-side shaft 41 of the link member 40 in the ascending direction of the operating body 30 and the second regulation portion 22 that regulates the movement of the support-side shaft 41 in a direction intersecting the ascending direction, and is provided with the flat spring portion 26 that presses the support-side shaft 41 against both the second regulation portion 22 and the first regulation portion 23. Thereby, since it is possible to maintain a state where the support-side shaft 41 of the link member 40 is pressed against the second regulation portion 22 and the first regulation portion 23 (specifically, second sliding contact surface portion 22*a* and first sliding contact surface portion 23*a*) of the shaft body 21 by the flat spring portion 26, looseness between the base 10 and the link member 40 is eliminated, and thus it is possible to suppress backlash due to a vibration.

In the pressing operation device 1, the bearing 20 is provided with the intersection point K where the second regulation portion 22 and the first regulation portion 23 intersect each other, and the support-side shaft 41 is pressed toward the intersection point K by the flat spring portion 26. In this manner, it is possible to equally press the support-side shaft 41 against the second regulation portion 22 and the first regulation portion 23 through the flat spring portion 26, and to effectively suppress backlash due to a vibration.

In the pressing operation device 1, it preferable that the flat spring portion 26 includes the inclined pressing portion 26*c* which is inclined in the ascending direction of the operating body 30, the inclined pressing portion 26*c* faces both the second regulation portion 22 and the first regulation portion 23, and that the support-side shaft 41 is pressed against the second regulation portion 22 and the first regulation portion 23 by the inclined pressing portion 26*c*. In this manner, it is possible to support the support-side shaft 41 of the link member 40 from three directions through the second regulation portion 22, the first regulation portion 23 and the inclined pressing portion 26*c*, and to suppress backlash due to a vibration with a relatively simple configuration.

In the pressing operation device 1, the inclined pressing portion 26*c* extends away from the tip of the first regulation portion 23 and further obliquely toward the ascending direction. When the operating body 30 is incorporated in the base 10, the support-side shaft 41 of the link member 40 comes into contact with the inclined pressing portion 26*c*, and is guided to a position of contact with both the second regulation portion 22 and the first regulation portion 23. In this manner, the support-side shaft 41 of the link member 40 is moved closer to the base 10 side from the operating body 30 side, and the support-side shaft 41 is contacted and compressed with and into the inclined pressing portion 26*c*, thereby allowing the support-side shaft 41 to be positioned and supported within a space surrounded by the second sliding contact surface portion 22*a* of the second regulation portion 22, the first sliding contact surface portion 23*a* of the first regulation portion 23 and one surface 26*d* of the inclined pressing portion 26*c*. Therefore, it is possible to relatively easily assemble the pressing operation device 1.

The pressing operation device 1 is provided with the vibration generation portion 50 that gives a vibration force to the operating body 30 when the operating body 30 is pressed. In this manner, when a vibration due to the vibration generation portion 50 is transmitted to an operator as a response to an operation input to the operating body 30, or the like, this vibration is transmitted from the operating body 30 through the link member 40 to the flat spring portion 26. Therefore, the vibration of the operating body 30 is effectively attenuated by the flat spring portion 26, and thus it is possible to more efficiently control the vibration.

As described above, the present invention has been described by way of preferred examples, but the present invention is not limited to the configuration of the embodiment.

In the aforementioned embodiment a configuration is used in which the vibration generation portion 50 that gives a vibration force to the operating body 30 when the operating body 30 is pressed is provided, but a configuration may be used in which the vibration generation portion 50 is not included without being limited thereto.

In addition, in the aforementioned embodiment, a configuration is used in which the flat spring portion 26 as a spring member is included, but there is no limitation thereto. For example, as the spring member, a configuration or the like may be used which includes an inclined pressing portion having a rectangular flat shape disposed at the intersection point K toward one surface and a coil spring that presses the inclined pressing portion from the other surface side toward the intersection point K. The configuration of the spring member is arbitrary unless contrary to the object of the present invention.

In addition, in the aforementioned embodiment, the link member 40 is formed so that one metal wire is bent in an approximately C-shape, but there is no limitation thereto. For example, as the link member 40, a pantograph structure may be used, or a configuration or the like may be used in which the member is made of a synthetic resin, the support-side shaft and an operating portion installation portion are formed in a cylindrical shape and disposed in parallel to each other, and the support-side shaft and the link-side shaft are connected to each other by a flat plate-like connection portion.

Meanwhile, the aforementioned embodiment shows merely a representative configuration of the present invention, and the present invention is not limited to the embodiment. That is, various modifications can be carried out by those skilled in the art within the scope of the present invention in accordance with knowledge of the related art. Such modifications are naturally included in the scope of the present invention, insofar as the configuration of the pressing operation device of the present invention is provided.

It should be understood by those skilled in the art that various modifications, combinations, sub-combinations and alterations may occur depending on design requirements and other factors insofar as they are within the scope of the appended claims of the equivalents thereof.

What is claimed is:

1. A pressing operation device comprising:

a base;

an operating body liftably provided on the base;

a link member configured to couple the base and the operating body, the link member including:

a support-side shaft;

at least one link-side shaft parallel to the support-side shaft, the at least one link-side shaft rotatable coupled to the operating body; and a connection portion for connecting the support-side shaft and the at least one link-side shaft so as to integrally form the link member, and a bearing provided on the base, the bearing rotatable supporting the support-side shaft, the bearing including:

a first regulation portion configured to regulate movement of the support-side shaft in an ascending direction of the operating body;

a second regulation portion configured to regulate the movement of the support-side shaft in a direction intersecting the ascending direction;

a spring member configured to press the support-side shaft against both the first regulation portion and the second regulation portion.

2. The pressing operation device according to claim 1, wherein the bearing has an intersection point where the first regulation portion and the second regulation portion meet each other, and the spring member presses the support-side shaft toward the intersection point.

3. The pressing operation device according to claim 1, wherein the spring member includes an inclined pressing portion which is inclined with respect to the ascending direction, the inclined pressing portion facing both of the first regulation portion and the second regulation portion, thereby pressing the support-side shaft against both of the first regulation portion and the second regulation portion.

4. The pressing operation device according to claim 3, wherein the inclined pressing portion is away from a tip of the first regulation portion and further extends obliquely toward the second pressing portion, and when the operating body is pressed downward to the base, the support-side shaft comes into contact with the inclined pressing portion, and is guided thereby to a position of contact with both the first regulation portion and the second regulation portion.

5. The pressing operation device according to claim 1, further comprising:

a vibration generation portion configured to give a vibration force to the operating body when the operating body is pressed.

* * * * *